US008419069B2

(12) United States Patent
Egli et al.

(10) Patent No.: US 8,419,069 B2
(45) Date of Patent: Apr. 16, 2013

(54) METHOD FOR PRODUCING A DATA CARRIER

(75) Inventors: Stefan Egli, Basel (CH); Stephan Hofstetter, Niedererlinsbach (CH); Paul Christen, Aarau (CH)

(73) Assignee: Trüb AG, Aarau (CH)

( * ) Notice: Subject to any disclaimer, the term of this patent is extended or adjusted under 35 U.S.C. 154(b) by 479 days.

(21) Appl. No.: 12/089,330

(22) PCT Filed: Oct. 6, 2006

(86) PCT No.: PCT/CH2006/000550

§ 371 (c)(1),
(2), (4) Date: Apr. 4, 2008

(87) PCT Pub. No.: WO2007/041882

PCT Pub. Date: Apr. 19, 2007

(65) Prior Publication Data

US 2008/0224463 A1 Sep. 18, 2008

(30) Foreign Application Priority Data

Oct. 12, 2005 (EP) ..... 05405581

(51) Int. Cl.
*B42D 15/00* (2006.01)

(52) U.S. Cl.
USPC ..... 283/70; 283/67; 283/72; 283/74; 283/75; 283/91

(58) Field of Classification Search ..... 281/51; 283/67, 70, 72, 74, 75, 85, 86, 88, 91, 94, 283/100, 117, 901
See application file for complete search history.

(56) References Cited

U.S. PATENT DOCUMENTS

| | | | | |
|---|---|---|---|---|
| 4,629,215 | A | 12/1986 | Maurer et al. | |
| 4,735,670 | A | 4/1988 | Maurer et al. | |
| 4,869,532 | A * | 9/1989 | Abe et al. | 283/88 |
| 2004/0164545 | A1 * | 8/2004 | Christianson et al. | 283/81 |
| 2006/0145468 | A1 * | 7/2006 | Plaschka et al. | 283/72 |
| 2007/0246932 | A1 * | 10/2007 | Heine et al. | 283/94 |

FOREIGN PATENT DOCUMENTS

| | | |
|---|---|---|
| CA | 2 405 249 | 3/2004 |
| EP | 0 723 246 | 7/1996 |
| EP | 1 389 537 | 2/2004 |
| GB | 2 132 136 | 7/1984 |
| WO | WO 02/35444 | 5/2002 |
| WO | 2006/061301 | 6/2006 |

* cited by examiner

*Primary Examiner* — Dana Ross
*Assistant Examiner* — Justin V Lewis
(74) *Attorney, Agent, or Firm* — The Webb Law Firm

(57) ABSTRACT

In order to produce a data carrier, a substrate is printed with a printing ink and personalized by means of a laser. The printing ink is laser-active and is converted at least in regions during the personalization in such a way that, for example, a silver-grade pigment is formed which is readily visible only when the substrate is inclined. In particular, the printing ink has a comparatively small proportion of carbon black that is converted by the laser essentially without disturbing combustion and overall formation.

18 Claims, 1 Drawing Sheet

METHOD FOR PRODUCING A DATA CARRIER

BACKGROUND OF THE INVENTION

1. Field of the Invention

The invention relates to a method for producing a data carrier, a substrate being provided with at least one security element. The invention additionally relates to a data carrier having a substrate which is provided with a security element on at least one side and, for example, is labeled with a laser.

2. Description of Related Art

Methods of the aforementioned type have been known for a long time for producing, for example, identification documents, such as in particular identity cards, passports, drivers' licenses and bank cards. By means of laser beams, individual data, such as photographs, texts and numbers, is introduced into the plastic. In this case, organic molecules are burned by the laser beam and carbon black particles are formed as a result. The aforementioned data can be built up from such carbon black particles by means of appropriate control of the laser beam. If these carbon black particles are located in the interior of the plastic or of the substrate, comparatively high security against forgery is provided. The security against forgery can be increased in a known way by, for example, guilloche patterns of black or colored lines being printed on. This pattern can cover the data introduced with the laser beam. For example, a photograph can be substantially protected against forgery attempts by the guilloche lines extending into such a photograph. Such lines or similar security elements are to be printed comparatively densely in view of the security against forgery. However, the disadvantage here is that the identification and verification of the person on a photograph protected in such a way can be made more difficult by structures and, in particular, the guilloche lines. In addition, such lines or other security elements on portraits can be disruptive and/or be viewed as giving rise to cultural offense. Also known are transparent kinegrams for the protection of personalized elements on identification documents.

SUMMARY OF THE INVENTION

The invention is based on the object of devising a method of the aforementioned type and a data carrier which avoid the aforementioned disadvantages.

According to a development of the invention, laser-active printing ink is used for the printing of the security element and this is converted with the laser, at least in some regions. By means of such a conversion, for example in the region of a photograph, it is possible to convert the security element, for example in the region of the face, in such a way that it is invisible or barely visible when viewed normally and in any case is not disruptive. The printing ink is preferably converted into a silvery pigment. This is barely visible when viewed normally, above all in the lighter regions of a face.

According to a development of the invention, provision is made for the printing ink to have a proportion of black which is metered in such a way that the printing ink is converted by the laser substantially without disruptive burning. Using such a printing ink it is in particular possible to convert this into a silver-gray pigment, which cannot be detected in a normal view, in particular in the area of the face. In an inclined view, on the other hand, these lines can be detected comparatively simply, above all in the dark regions, for example in the region of the hair. Such lines are thus esthetically harmless but nevertheless form a substantial security element which can be detected reliably and simply, in particular by a specialist.

According to a development of the invention, the printing ink is converted into a silver-gray pigment.

Using such a silver-gray pigment, it is in particular possible to produce lines which present no difficulty from an esthetic point of view.

Preferably but not exclusively, lines are printed which are converted in the region of a photograph. In principle, however, such lines can also be printed or converted in a text or in the region of numbers.

Particularly suitable is a method in which the printing ink is an offset printing ink. This can be both a colored ink and a gray. Light hues are preferably used, for example mid-gray hues. According to a development of the invention, it is composed of about three parts of process yellow, about four parts of process black and about 200 parts of transparent white.

The method is suitable for producing all viewable documents which can be personalized by a laser. The document can be a card or a page of a booklet, for example what is known as a data page.

The data carrier according to the invention has a substrate which is provided on at least one side with a security element, which is printed and which is differently visible, depending on the viewing angle.

According to a development of the invention, the data carrier is printed with a printing ink which has a proportion of black of less than 5% by weight, preferably less than 3% by weight. The proportion of black is preferably 1-3% by weight. The proportion of black is formed in particular by carbon black particles. It has been shown that, given a comparatively small proportion of carbon black particles in the printing ink, no disruptive burning or bubbles is/are formed during the laser personalization. In particular, conversion of the printing ink into a silver-gray pigment can be achieved as a result. The conversion can be monitored. In addition, it has surprisingly been shown that this conversion effect is easily visible, in particular in darkly lasered regions. As a result, the angle of incidence of light has a substantial influence on the visibility. This effect is characterized by the fact that, given specific incidence of light, the regions of the printing ink activated by a laser light up in a silvery manner. At other angles of incidence of light, this effect is substantially weaker. The most advantageous effects are achieved in dark portions that are lasered over a large area. The data carrier according to the invention can therefore contain a photograph, for example, which contains esthetically non-disruptive guilloche lines, which are prominent only when viewed at an angle and can also be detected simply by a specialist and, given appropriate training, also by lay persons. As a result, a forgery can readily be detected immediately by a specialist.

BRIEF DESCRIPTION OF THE DRAWINGS

Exemplary embodiments of the invention will be explained in more detail below by using the single drawing, in which.

DETAILED DESCRIPTION OF THE INVENTION

Figure 1:
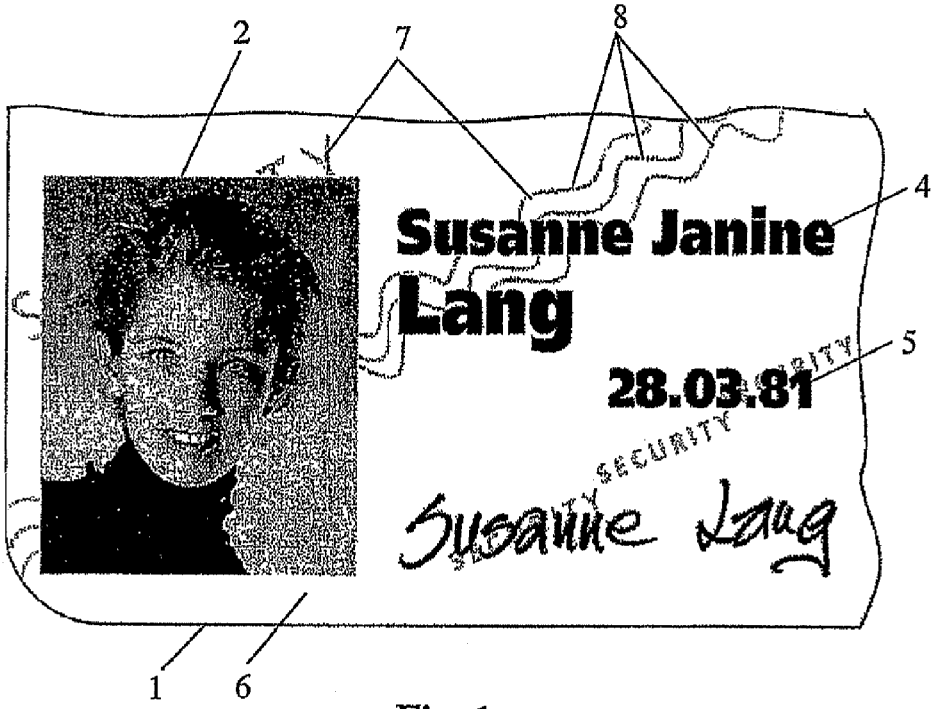
FIG. 1 shows a partial view of the data carrier according to the invention and FIG. 2 shows a partial view of the inclined data carrier.

FIG. 1 shows a portion of a data carrier 1 which, here, is personalized with a photograph 2, text 4 and numbers 5, for example an identification number. The substrate 6 is composed in the usual way of plastic, for example of polycarbonate or PVC, and can have one or more layers. The upper side shown can be coated with a varnish or the like. The photograph, the text 4 and the numbers 5 are engraved in with a laser in a manner known per se. The data carrier 1 is additionally provided with a security element 7, which is printed and, for example, forms a guilloche pattern comprising a plurality of comparatively fine curved lines 8. The security element 7 is, for example, produced with offset printing inks in the corresponding printing process. The security element 7 extends into the region of the photograph and/or the region of the text 4 and/or into the region of the numbers 5.

If the security element 7 is located outside the photograph, the text 4 and the numbers 5, it is not influenced during the introduction of the data with the laser. However, if the security element 7 is located in a region in which the laser beam penetrates into the substrate 6, the printing ink is activated and converted, as will be explained below.

The printing ink for producing the security element 7 is preferably but not exclusively an offset printing ink which is laser-active. It has in particular a comparatively small proportion of black in the form of carbon black particles. In relation to the entire printing ink, this proportion of black is preferably smaller than about 10% by weight, preferably smaller than 5% by weight and preferably smaller than 3% by weight. The proportion of black is preferably 1 to 3% by weight.

It has now been shown that, during the laser personalization, such a printing ink can be converted into a silver-gray pigment, for example, without disruptive burning and bubble formation. The conversion appropriately takes place only in the region in which the laser penetrates into the substrate 6 and into the printing ink. In these regions, the lines 8 which are otherwise easily visible are converted, for example into light-gray and in particular into silver-gray lines. These lines are barely visible in the light portions, for example in the fade of a portrait, but are comparatively easily visible in darker portions, above all when the data carrier 1 is inclined. Such lines 3 can be seen in the single figure, for example in the region of the hair. The lines 3 can be detected in particular by the practiced eye of a specialist. Attempts at forgery unavoidably lead to destruction or changing of such lines 3, which can be determined more simply and reliably by a specialist.

As mentioned, a suitable printing ink is preferably an offset printing ink. It can be applied to the substrate 6 in the usual way in the offset printing process. This printing ink has a proportion of black, this proportion of black preferably containing less than 30% by weight of carbon black. A suitable mixing ratio for such a printing ink is composed, for example, of three parts of process yellow, four parts of process black and 200 parts of transparent white. However, other inks are of course also conceivable here.

Figure 2:
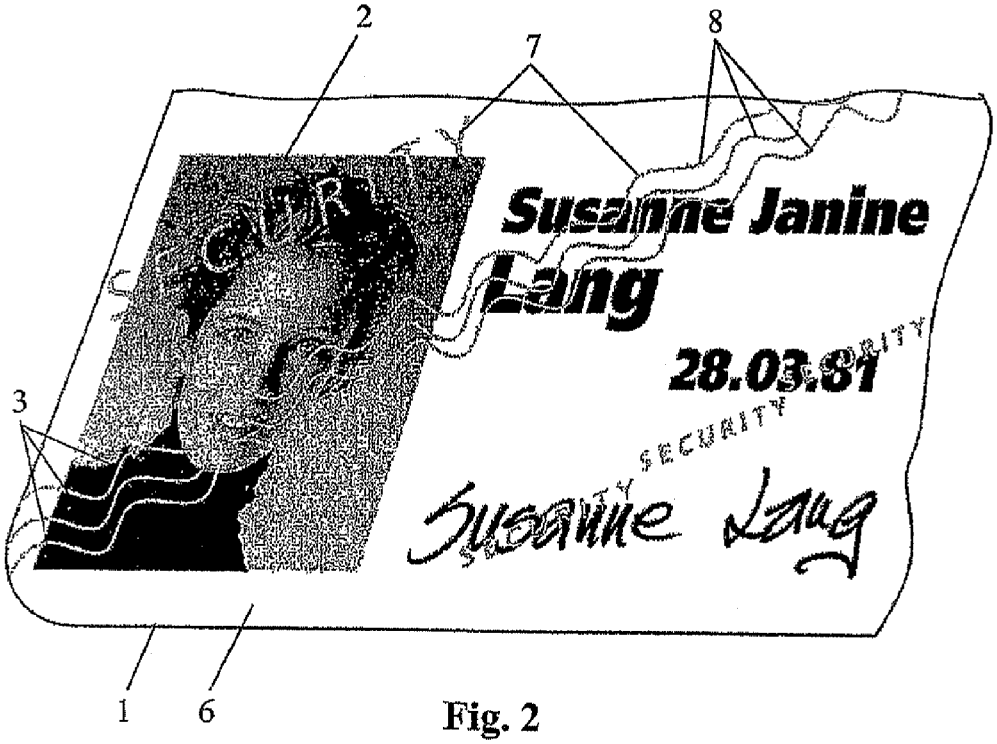

The security element 7 is formed in such a way in the unconverted region that it is differently visible, depending on the viewing angle. Thus, in the view according to FIG. 1, in which the viewing angle is approximately 90° to the plane of the substrate 6, the security element 7 can be seen comparatively weakly or not at all in the region of the photograph 2. In an inclined view according to FIG. 2, however, the security element 7 can be seen well or at least substantially better, even in the region of the photograph 2. In the normal view according to FIG. 1, the security element 7 is not disruptive or at least barely disruptive with regard to the photograph 2 or the portrait.

LIST OF DESIGNATIONS

1 Data carrier
2 Photograph
3 Lines
4 Text
5 Numbers
6 Substrate
7 Security element (print)
8 Lines

The invention claimed is:

1. A method for producing a data carrier comprising the steps of:

printing a security element on a substrate; and introducing data into the substrate via a laser, wherein the printing is done with a laser-active printing ink that has a proportion of black that is metered such that the printing ink is configured to be converted with the laser, wherein the converted printing ink is differently visible when the data carrier is tilted;

wherein by using the laser, data such as a photograph, a signature, a logo, or an alphanumeric element, are engraved into the substrate, and wherein the printing ink in the region in which data is engraved by said laser is converted into a different pigment by said laser.

2. The method as claimed in claim 1, wherein the different pigment is a silver-gray pigment.

3. The method as claimed in claim 1, wherein at least some regions of the security element having the printed ink are converted.

4. The method as claimed in claim 1, wherein lines printed in the photograph are converted.

5. The method as claimed in claim 1, wherein the printing ink is converted such that the printing ink is substantially not visible at a first angle of incidence of light and is visible or at least substantially more visible at a second angle of incidence of light in relation to the first angle of incidence of light.

6. The method as claimed in claim 1, wherein a guilloche pattern is printed and wherein at least one region of the guilloche pattern is converted by the laser.

7. The method as claimed in claim 1, wherein the printing ink is an offset printing ink.

8. The method as claimed in claim 6, wherein the printing ink is a colored ink or a light-gray ink.

9. The method as claimed in claim 7, wherein the printing ink includes a proportion of black, wherein the proportion of black contains less than 30% carbon black.

10. The method as claimed in claim 1, wherein the printing ink includes less than 10% by weight of carbon black or 1-3% by weight of carbon black.

11. The method as claimed in claim 10, wherein the printing ink has about three parts of process yellow, about four parts of process black, and about 200 parts of transparent white.

12. The method as claimed in claim 1, wherein the substrate is printed such that the printing ink extends in some regions of the substrate into the data of the substrate, wherein the data is one or more of a photograph, text, a signature, and numbers.

13. A data carrier comprising:

a substrate having a security element printed on at least one side of the substrate, wherein the security element is substantially not visible at a first angle of incidence of light and is visible or at least substantially more visible at a second angle of incidence of light in relation to the first angle of incidence of light; and personalized data introduced into the substrate, wherein the security element is printed with a laser-active printing ink having a proportion of black and white that is converted by a laser in at least one area in which data is engraved into a different pigment by said laser.

14. The data carrier as claimed in claim 13, wherein the printing ink is an offset printing ink.

15. The data carrier as claimed in claim 14, wherein the converted printing ink is substantially not visible in a substantially vertical plan view of the substrate and, in an inclined view, is visible or at least substantially more clearly visible in relation to the substantially vertical plan view.

16. The data carrier as claimed in claim 13, wherein the substrate is printed with a guilloche pattern.

17. The data carrier as claimed in claim 13, wherein the data carrier is an identification document selected from the group consisting of a passport, a driver's license, and a bank card.

18. The data carrier as claimed in claim 13, wherein the substrate forms a single layer or multilayer laminated card.

* * * * *

UNITED STATES PATENT AND TRADEMARK OFFICE

CERTIFICATE OF CORRECTION

PATENT NO. : 8,419,069 B2
APPLICATION NO. : 12/089330
DATED : April 16, 2013
INVENTOR(S) : Egli et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 630 days.

Signed and Sealed this
First Day of September, 2015

Michelle K. Lee

Michelle K. Lee
*Director of the United States Patent and Trademark Office*